United States Patent [19]

Edwards

[11] 4,438,868

[45] Mar. 27, 1984

[54] ENVELOPE VENDING MACHINE

[76] Inventor: Raymond M. Edwards, 1037 Keith Dr., Hurst, Tex. 76053

[21] Appl. No.: 348,851

[22] Filed: Feb. 16, 1982

[51] Int. Cl.[3] ..... B65H 3/26

[52] U.S. Cl. ..... 221/240; 221/268

[58] Field of Search ..... 221/240, 268, 20, 272, 221/274, 19; 194/2

[56] References Cited

U.S. PATENT DOCUMENTS

| | | | |
|---|---|---|---|
| 868,773 | 10/1907 | Gorham et al. | 221/240 X |
| 914,993 | 3/1909 | Thexton | 221/240 X |
| 982,812 | 1/1911 | Grover et al. | 221/20 |
| 1,460,123 | 6/1923 | Baird et al. | 221/240 X |
| 2,862,642 | 12/1958 | Shipman | 221/240 X |
| 3,298,570 | 1/1967 | Skorey et al. | 221/272 X |

*Primary Examiner*—Stanley H. Tollberg
*Attorney, Agent, or Firm*—Charles D. Gunter, Jr.

[57] ABSTRACT

An envelope vending machine is shown for dispensing single envelopes. The machine includes a housing having a closed top, a closed bottom, and sidewalls therebetween, and an envelope dispensing slot in one of the sidewalls. A slotted partition having upper and lower surfaces and front and rear edges is supported in the housing generally parallel with the closed bottom. An envelope support member carried on the upper surface of the slotted partition has a depending flange which is received within the slot in the partition. A coin chute having a coin slide therein has a longitudinal extent received within the housing and engaging the support member depending flange whereby reciprocal movement of the coin slide in the coin chute reciprocates the envelope support on the slotted partition to thereby dispense an envelope through the envelope dipensing slot.

7 Claims, 5 Drawing Figures

ENVELOPE VENDING MACHINE

BACKGROUND OF THE INVENTION

The present invention relates generally to vending machines and specifically to a coin operated vending machine for dispensing single envelopes.

Many Post Office locations presently have available postage stamp dispensing machines. In addition, certain locations have available envelope dispensing machines which are coin operated and dispense a sealed packet of envelopes.

The consumer has, in the past, thus been provided with either machines which dispense only postage stamps or machines which dispense packets of stamped or unstamped envelopes but has not had available machines for dispensing single stamped envelopes.

SUMMARY OF THE INVENTION

The present envelope vending machine includes a housing having a closed top, a closed bottom, and sidewalls therebetween, and an envelope dispensing slot in one of the sidewalls for dispensing a single envelope. A slotted partition having upper and lower surfaces and front and rear edges is supported in the housing generally parallel with the closed bottom. An envelope support member is carried on the upper surface of the slotted partition. The support member has a depending flange received within the slot in the partition.

The vending machine is provided with a coin chute having a coin slide. The coin slide has a longitudinal extent received within the housing and engaging the support member depending flange. Reciprocal movement of the coin slide in the coin chute reciprocates the envelope support on the slotted partition to thereby dispense an envelope through the envelope dispensing slot.

Preferably, the slotted partition has a recess formed on the front edge thereof adapted to receive the flap of an envelope to be dispensed. The envelope support member carried on the upper surface of the slotted partition has a leading edge adapted to engage the envelope flap received in the partition recess. The coin slide longitudinal extent received within the housing engages the support member depending flange whereby reciprocal movement of the coin slide in the coin chute reciprocates the envelope support on the slotted partition to thereby dispense an envelope through the envelope dispensing slot.

The slotted partition divides the interior of the housing into a lower coin chute compartment and an upper envelope storage compartment. A supply of envelopes can be stacked in the upper compartment on the envelope support member with the envelope flaps facing downwardly, the envelopes being arranged normal to the longitudinal axis of the envelope support member. Vertical ribs located in the upper compartment on opposite interior sidewalls thereof are spaced from the envelope dispensing wall of the housing a selected distance to prevent lateral movement within the housing of the envelopes stacked on the envelope support. A letter weight comprising a flat leaf having a transverse pin fitted therein and extending downwardly therefrom is positioned in the housing on top of the letter stack between the vertical ribs and the envelope dispensing wall.

The envelope support member and the slotted partition are provided with holes therein, the holes being alignable with the leaf pin to receive the pin when all of the envelopes are dispensed from the upper compartment. When the pin is received within the aligned holes, the weight, support member and slotted partition are locked in place to prevent further movement thereof.

Additional objects, features, and advantages will be apparent from the description which follows.

DETAILED DESCRIPTION OF THE INVENTION

Figure 1:
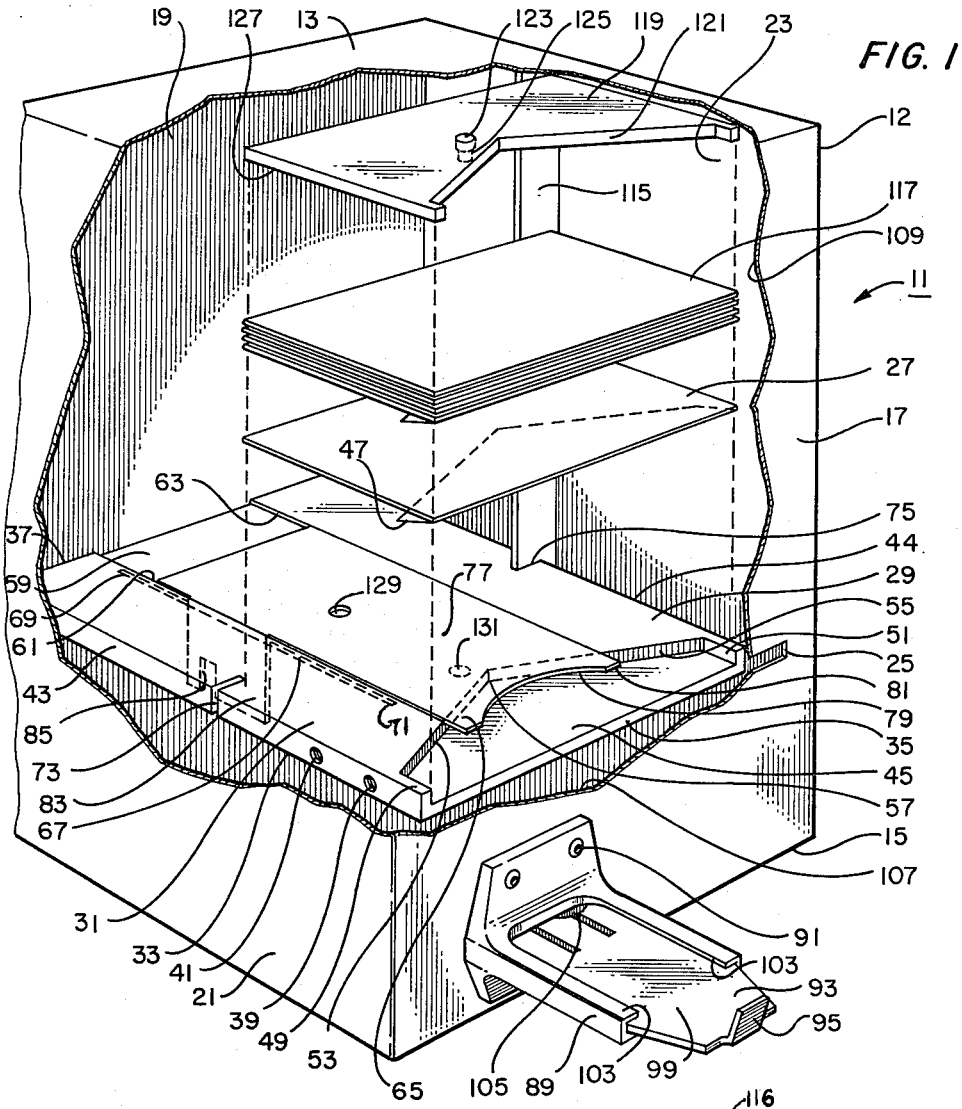
FIG. 1 is a partly broken away perspective view of the device of the invention with the interior components thereof shown in exploded fashion.

FIG. 1 shows an envelope vending machine of the present invention designated generally as 11. Vending machine 11 has a closed top 13, a closed bottom 15, front and rear sidewalls 17, 19, and left and right sidewalls 21, 23. Front sidewall 17 is provided with an envelope dispensing slot 25 for dispensing a single envelope 27.

A slotted partition 29 having upper and lower surfaces 31, 33 and front and rear edges 35, 37 is supported in housing 12 generally parallel with closed bottom 15. Partition 29 is preferably supported by means of screws or rivets passing through holes 39, 41 in side 43 of partition 29 and engaging sidewalls 21, 23 of housing 12. Any convenient method for fixedly supporting partition 29 in housing 12 can be utilized such as tack welding and the like.

Slotted partition 29 has a recess 45 formed in the front edge 35 thereof adapted to receive the flap 47 of an envelope 27 to be dispensed. The recess 45 in partition 29 is suitably formed to provide a pair of parallel sidewalls 49, 51 connected by inclined sidewalls 53, 55 to an apex 57. The general shape of recess 45 in partition 29 is that of the flap 47 of an envelope 27.

Partition 29 has a channel 59 formed in the upper surface thereof which intersects recess 45 formed in front edge 35. Channel 59 has left and right sidewalls 61, 63. Channel 59 is not cut the entire depth of recess 45 in partition 29, thereby creating a lip 65 (shown in dotted lines) at the point of intersection with recess 45.

A slot 67 is cut along one of the sidewalls of channel 59, in this case sidewall 61, and has an upper extent 69 and a lower extent 71. Lower extent 71 begins approximately one third of the length of side 43 of partition 29 from front edge 35 and terminates prior to reaching rear edge 37. Notches 73, 75 are provided in sides 43, 44 of partition 29, each notch being equi-distant from front edge 35.

An envelope support member 77 is carried on the upper surface 31 of slotted partition 29 in channel 59. Support member 77 has an arc shaped cut-out 79 in the leading edge 81 thereof adapted to engage the envelope flap 47 received in partition recess 45. Support member 77 is slidably received within channel 59 and is reciprocable in channel 59 between an extended position for dispensing an envelope and a retracted position for receving an envelope flap in partition recess 45. Support member 77 has a depending flange 83 which extends downwardly from one edge thereof in a direction normal to the plane of support member 77, flange 83 being received within slot 67 in partition 29 when support member 77 is slidably received within channel 59.

Figure 2:
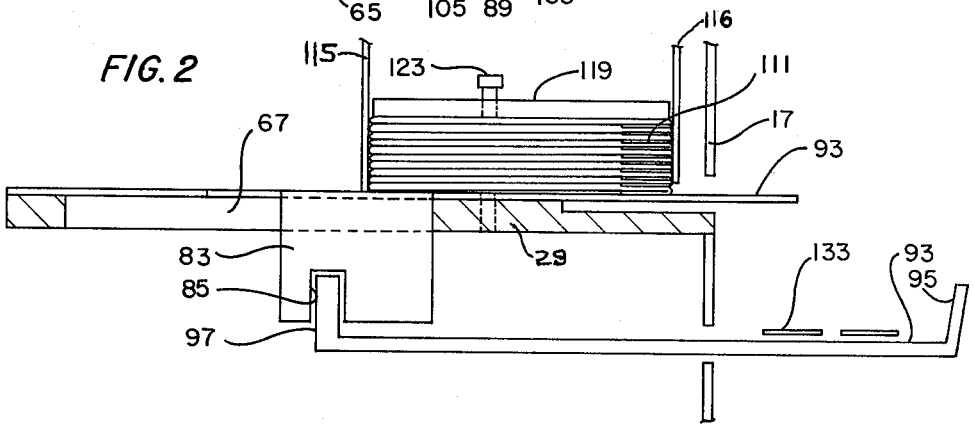
FIG. 2 is a schematic view of the working parts of the device of FIG. 1 showing money being deposited in the coin slide.

A coin chute 89 is mounted on the lower portion of sidewall 17 as by rivets 91 and is provided with a coin slide 93. Coin slide 93, as shown in FIGS. 1 and 2, is an elongated metal strip having a thumb tab 95 at the outer extent thereof and having an upwardly extending leg 97 at the opposite extent which is received within notch 85 in depending flange 83 of support member 77. Outer extent 99 of coin slide 93 is carried between a pair of oppositely facing parallel tracks 101, 103 of coin chute 89. One or more openings 105 in coin slide 93 are provided for receiving coins.

The leg 97 of coin slide 93 engages flange 83 of support member 77 whereby reciprocal movement of coin slide 93 in coin chute 89 reciprocates the envelopes support member 77 on slotted partition 29 to thereby dispense an envelope 27 through envelope dispensing slot 25.

Slotted partition 29, as shown in FIG. 1, divides housing 12 into a lower coin chute compartment 107 and an upper envelope storage compartment 109 whereby a supply of envelopes 111 can be stacked in upper compartment 109 on envelope support member 77 with the envelope flaps 47 facing downwardly. Envelopes 111 are arranged normal to the longitudinal axis of the envelope support member 77.

Upper compartment 109, as shown in FIG. 1, is provided with a pair of vertical ribs 113, 115 on opposite interior sidewalls 21, 23 thereof. Vertical ribs 113, 115 can extend from bottom 15 to top 13 of housing 12 and are arranged normal to the plane of sidewalls 21, 23. Vertical ribs 113, 115 are received within notches 73, 75, respectively, in slotted partition 29 and are spaced a selected distance from the envelope dispensing wall 17 of housing 12 to prevent lateral movement within housing 12 of the envelopes 111 stacked on envelope support member 77. A vertical partition 16 (see FIGS's. 2–5) can also be provided between top 13 and bottom 15 inside upper compartment 109 parallel to wall 17 to restrain envelopes 111. The distance between vertical ribs 113, 115 and front sidewall 17 or vertical partition 116 is roughly the width 117 of the envelope stack as shown in FIG. 1.

A letter weight 119 is position in housing 12 on top of the letter stack 111 between vertical ribs 113, 115 and the vertical partition 116. Letter weight 119 comprises a flat leaf having a cutout portion 121 shaped similar to recess 45 in partition 29 and having a transverse pin 123 disposed in a pin hole 125. Transverse pin 123 thus extends downwardly from the underside 127 of letter weight 119 normal to the plane thereof. Support member 77 and slotted partition 29 are provided with pin receiving holes 129, 131, respectively, said holes being alignable with pin hole 125 to receive transverse pin 123 when all of the envelopes 111 have been dispensed from upper compartment 109, thereby locking the letter weight 119, support member 77, and slotted partition 29 to prevent further movement thereon.

The operation of the envelope vending machine of the invention will now be described. Top 13 or front sidewall 17 of the housing 12 can be conveniently provided with a hinged door (not shown) hinges and a suitable lock whereby the housing maybe opened to allow a stack of envelopes 111 to be placed within upper compartment 109 normal to the longitudinal axis of channel 59 with the envelope flaps facing downwardly and closest to the recess 45 in slotted partition 29. Letter weight 119 is then placed on top of the stack of letters 111 with the cutout portion 121 aligned with recess 45. The coin slide 93 is in the fully extended position with leg 97 engaging notch 85 in depending flange 83. The user then inserts coins 133 in the openings 105 in coin slide 93 and the coin slide is pushed inwardly in the direction of front sidewall 17 by means of thumb tab 95.

Figure 3:
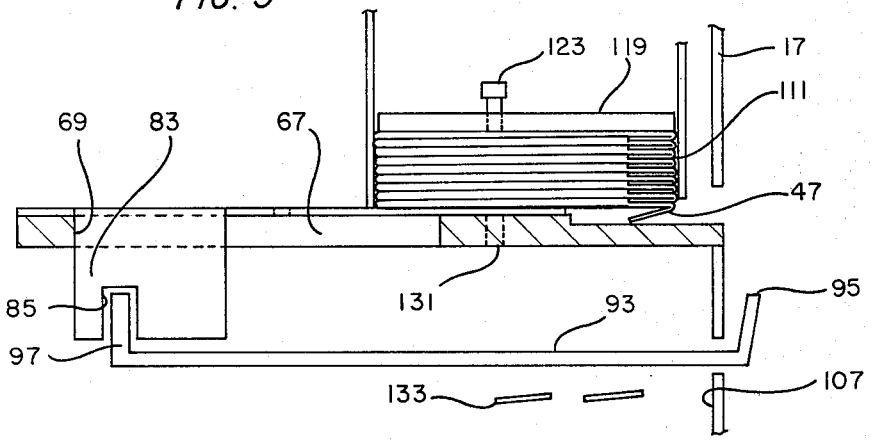
FIG. 3 is a schematic view similar to FIG. 2 showing the coin slide in the fully retracted position.

FIG. 3 shows the coin slide 93 being pushed inwardly to the fully retracted position whereby depending flange 83 contacts the upper extent 69 of slot 67 and coins 133 fall through the openings 105 in coin slide 93 into the lower compartment 107. An envelope support member 77 is reciprocated rearwardly in channel 59, arc-shaped cutout 79 passes over recess 45 and allows the flap 47 of the lowermost envelope to be received in partition recess 45.

Figure 4:
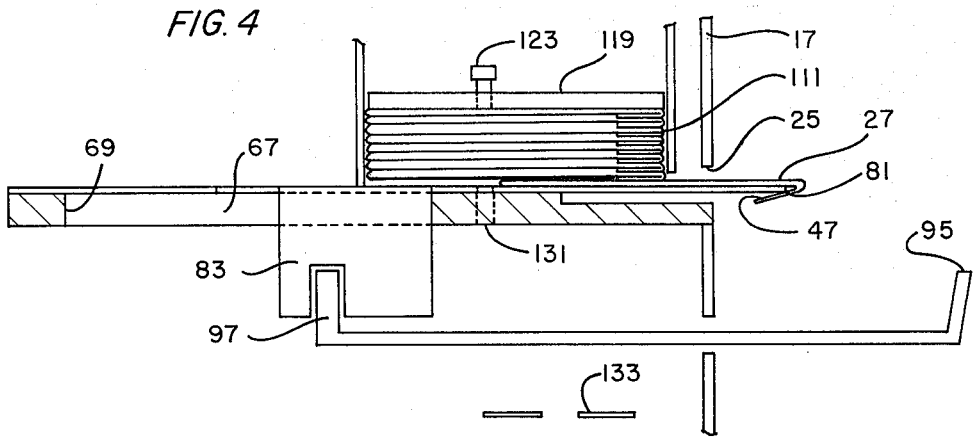
FIG. 4 is a schematic view similar to FIG. 3 showing the coin slide in the fully extended position.
Figure 5:
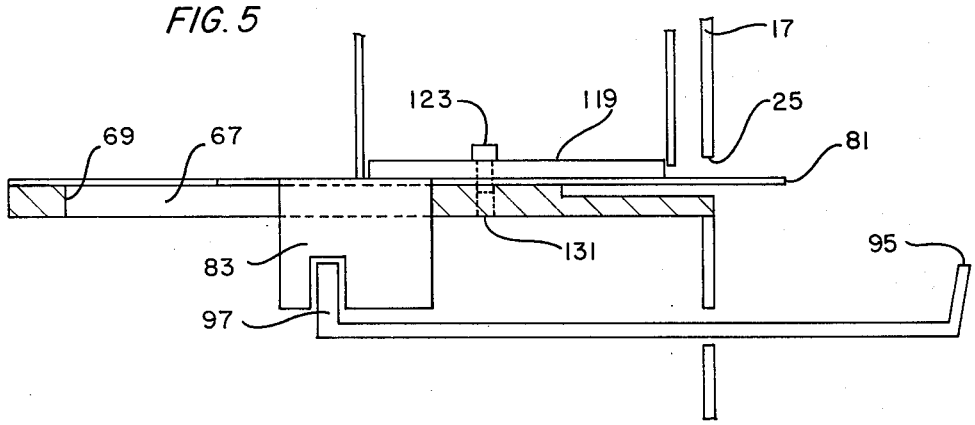
FIG. 5 is a schematic view similar to FIG. 4 but showing the upper envelope storage compartment empty.

The coin slide 93 is then pulled outwardly to the fully extended position, as shown in FIG. 4, whereby the leading edge 81 of envelope support member 77 contacts the underside of flap 47 to dispense envelope 27 through the envelope dispensing slot 25 in front sidewall 17. In the sequence of operations shown in FIGS. 2–4, the transverse pin 123 in letter weight 119 is separated from holes 129, 131 by the stack of letters 111.

When the stack of letters 111 has been dispensed, transverse pin 123 is received within aligned holes 129, 131 in member 77 and partition 29, respectively, to lock member 77 and partition 29 with the leading edge 81 of support member 77 extending through envelope dispensing slot 25. In this way, the user knows when the machine is empty since coins can be inserted in openings 105 but coin slide 93 cannot be reciprocated.

While the invention has been shown in only one of its forms, it is not thus limited but is susceptible to various changes and modifications without departing from the spirit thereof.

I claim:

1. An envelope vending machine for dispensing single envelopes, comprising:

a housing having a closed top, a closed bottom, and sidewalls therebetween, and an envelope dispensing slot in one of said sidewalls;

a stationary slotted partition having upper and lower surfaces and front and rear edges supported in said housing generally parallel with said closed bottom, said partition having a recess formed in the front edge thereof in the shape of an envelope flap, said recess being adapted to receive the flap of an envelope to be dispensed, said slotted partition having a channel formed in the upper surface thereof which intersects said recess formed in said front edge;

a moveable envelope support member slidably received within said channel, said support member having a leading edge adapted to engage said envelope flap received in said partition recess and said support member having a depending flange received within said slot in said partition, said support member being reciprocable in said channel between an extended position for dispensing an envelope and a retracted position for receiving an envelope flap in said partition recess; and a coin chute having a coin slide therein, said coin slide having a longitudinal extent received within said housing and engaging said support member depending flange whereby reciprocal movement of said coin slide in said coin chute reciprocates said envelope support member on said slotted partition to thereby dispense an envelope through said envelope dispensing slot.

2. The machine of claim 1, wherein said slotted partition divides the interior of said housing into a lower coin chute compartment and an upper envelope storage compartment, whereby a supply of envelopes can be stacked in said upper compartment on said envelope support member with the envelope flaps facing downwardly said envelopes being arranged normal to the longitudinal axis of said envelope support member.

3. The machine of claim 2, wherein said upper compartment has a vertical rib on each of the opposite interior sidewalls thereof said vertical ribs being spaced from the envelope dispensing wall of said housing a selected distance to prevent lateral movement within said housing of said envelopes stacked on said envelope support member.

4. The machine of claim 1 further comprising:

a letter weight positioned in said housing on top of said letter stack between said vertical ribs and said envelope dispensing wall.

5. The machine of claim 4, wherein said letter weight comprises a flat leaf having a transverse pin fitted therein and extending downwardly from the underside of said leaf normal to the plane thereof and wherein said envelope support member and said slotted partition have holes therein, said holes being alignable with said pin to receive said pin when all of said envelopes are dispensed from said upper compartment, thereby locking said weight, support member and slotted partition to prevent further movement thereof, said support member being locked in the extended position.

6. The machine of claim 5, wherein said envelope support member leading edge has an arc-shaped cutaway portion.

7. The machine of claim 6, wherein the slot in said slotted partition is located along one of the sides of said channel in said upper surface.

* * * * *